US011238820B2

(12) United States Patent
Cheng

(10) Patent No.: US 11,238,820 B2
(45) Date of Patent: Feb. 1, 2022

(54) CHARGE RELEASE CIRCUIT, DISPLAY SUBSTRATE, DISPLAY DEVICE AND CHARGE RELEASE METHOD THEREOF

(71) Applicant: BOE TECHNOLOGY GROUP CO., LTD., Beijing (CN)

(72) Inventor: Hongfei Cheng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 882 days.

(21) Appl. No.: 16/065,492

(22) PCT Filed: Nov. 8, 2017

(86) PCT No.: PCT/CN2017/109965
§ 371 (c)(1),
(2) Date: Jun. 22, 2018

(87) PCT Pub. No.: WO2018/126785
PCT Pub. Date: Jul. 12, 2018

(65) Prior Publication Data

US 2021/0210038 A1 Jul. 8, 2021

(30) Foreign Application Priority Data

Jan. 3, 2017 (CN) ..... 201720002380.1

(51) Int. Cl.
*G09G 3/36* (2006.01)

(52) U.S. Cl.
CPC ... *G09G 3/3648* (2013.01); *G09G 2300/0426* (2013.01); *G09G 2310/0245* (2013.01);
(Continued)

(58) Field of Classification Search
CPC ..... G09G 3/3648; G09G 2320/0257; G09G 2320/0238; G09G 2300/0426; G09G 2310/0245
See application file for complete search history.

(56) References Cited

U.S. PATENT DOCUMENTS 7,098,880 B2 8/2006 Inoue et al.
8,411,240 B2 4/2013 Harada et al.
(Continued)

FOREIGN PATENT DOCUMENTS

CN 202473180 U 10/2012
CN 102867491 A 1/2013
(Continued)

OTHER PUBLICATIONS

International Search Report of PCT/CN2017/109965 in Chinese, dated Feb. 7, 2018 with English translation.
(Continued)

*Primary Examiner* — Benyam Ketema
(74) *Attorney, Agent, or Firm* — Collard & Roe, P.C.

(57) ABSTRACT

A charge release circuit, a display substrate, a display device and a charge release method thereof are provided. The charge release circuit including: a controller, a charge release sub-circuit and a first conductor, wherein the charge release sub-circuit is respectively connected with the controller, the first conductor and a second conductor in an active area of an array substrate, and the charge release sub-circuit is configured to conduct the first conductor and the second conductor under a control of the controller, so as to allow charges on the second conductor to move to the first conductor. The charge release circuit can solve the problem that the display panel in the black-screen state displays bright spots so as to reduce the number of bright spots on the display panel in the black-screen state.

20 Claims, 7 Drawing Sheets

(52) U.S. Cl.
CPC ..... *G09G 2320/0238* (2013.01); *G09G 2320/0257* (2013.01)

(56) References Cited

U.S. PATENT DOCUMENTS

| | | | | |
|---|---|---|---|---|
| 9,047,842 | B2 * | 6/2015 | Ohkawa | G09G 3/3655 |
| 9,720,297 | B2 * | 8/2017 | Wei | G02F 1/136204 |
| 9,977,300 | B2 | 5/2018 | Xu et al. | |
| 10,908,465 | B2 * | 2/2021 | Zeng | H01L 27/1251 |
| 2008/0143702 | A1 * | 6/2008 | Park | G09G 3/3648 345/211 |
| 2008/0165109 | A1 * | 7/2008 | Joo | G09G 3/3677 345/98 |
| 2008/0265250 | A1 * | 10/2008 | Huang | G02F 1/136204 257/48 |
| 2010/0079443 | A1 * | 4/2010 | Chang | G09G 3/3677 345/214 |
| 2010/0109996 | A1 | 5/2010 | Park et al. | |
| 2010/0156883 | A1 * | 6/2010 | Yamato | G09G 3/3696 345/213 |
| 2011/0057924 | A1 | 3/2011 | Yanai | |
| 2011/0292005 | A1 * | 12/2011 | Lau | G09G 3/3688 345/204 |
| 2012/0139436 | A1 * | 6/2012 | Park | G09G 3/3648 315/240 |
| 2013/0147697 | A1 * | 6/2013 | Sung | G02F 1/136204 345/87 |
| 2014/0232964 | A1 | 8/2014 | Tseng et al. | |
| 2015/0206477 | A1 | 7/2015 | Xu | |
| 2016/0155409 | A1 | 6/2016 | Jeoung et al. | |
| 2017/0176824 | A1 | 6/2017 | Xu et al. | |
| 2017/0192318 | A1 * | 7/2017 | Wang | G02F 1/13452 |
| 2018/0108649 | A1 * | 4/2018 | Cheng | H01L 27/0296 |

FOREIGN PATENT DOCUMENTS

| | | | |
|---|---|---|---|
| CN | 103412427 | A | 11/2013 |
| CN | 104297969 | A | 1/2015 |
| CN | 204667021 | U | 9/2015 |
| CN | 206370279 | U | 8/2017 |
| EP | 2 444 959 | A1 | 4/2012 |
| JP | H10282471 | A | 10/1998 |
| JP | 2003295829 | A | 10/2003 |
| JP | 2004109824 | A | 4/2004 |
| JP | 2011059380 | A | 12/2008 |
| JP | 2012108548 | A | 6/2012 |
| JP | 2012173469 | A | 9/2012 |
| WO | 2016/201824 | A1 | 12/2016 |

OTHER PUBLICATIONS

Notice of Transmittal of the International Search Report of PCT/CN2017/109965 in Chinese, dated Feb. 7, 2018.

Written Opinion of the International Searching Authority of PCT/CN2017/109965 in Chinese, dated Feb. 7, 2018 with English translation.

Indian Office Action in Indian Application No. 201817036332, dated Jul. 3, 2020.

English translation of Extended European Search Report in EP 17882277.1 dated Jul. 28, 2020.

European Office Action in European Application No. 17882277.1 dated May 14, 2021.

Japanese Office Action in Japanese Application No. 2018-548389 dated Jul. 19, 2021 with English translation.

* cited by examiner

CHARGE RELEASE CIRCUIT, DISPLAY SUBSTRATE, DISPLAY DEVICE AND CHARGE RELEASE METHOD THEREOF

CROSS REFERENCE TO RELATED APPLICATIONS

This application is the National Stage of PCT/CN2017/109965 filed on Nov. 8, 2017, which claims priority under 35 U.S.C. § 119 of Chinese Application No. 201720002380.1 filed on Jan. 3, 2017, the disclosure of which is incorporated by reference.

The application claims priority to the Chinese patent application No. 201720002380.1, filed on Jan. 3, 2017, the entire disclosure of which is incorporated herein by reference as part of the present application.

TECHNICAL FIELD

Examples of the present disclosure relate to a charge release circuit, a display substrate, a display device and a charge release method thereof.

BACKGROUND

A liquid crystal display (LCD) includes a color filter (CF) substrate, an array substrate, and liquid crystals disposed between the CF substrate and the array substrate, the color filter (CF) substrate and the array substrate are oppositely arranged.

For instance, a common electrode is formed on a base substrate of the CF substrate, a plurality of transversely arranged gate lines and a plurality of longitudinally arranged data lines are formed on a base substrate of the array substrate, the gate lines and the data lines are intersected with each other to form a plurality of pixel regions, and a thin-film transistor (TFT) and a pixel electrode are formed in each of the plurality of pixel regions. For instance, the TFT includes a gate electrode connected with the gate line, a source electrode connected with the data line, and a drain electrode connected with the pixel electrode. When a display panel is controlled to display an image, the TFT can be switched on by applying a voltage to the gate electrode through the gate line, a pixel voltage is applied to the pixel electrode through the data line, the source electrode and the drain electrode, and a common voltage is applied to the common electrode. The liquid crystals are rotated under an action of the pixel voltage and the common voltage, so that the display panel can display the image. When the display panel is not required to be controlled to display the image, the liquid crystals are not rotated by stopping applying voltages to the pixel electrode and the common electrode, so that the display panel can be in a black-screen state.

SUMMARY

Examples of the present disclosure provide a charge release circuit, a display substrate, a display device and a charge release method thereof.

At least one example of the present disclosure provides a charge release circuit, comprising: a controller, a charge release sub-circuit and a first conductor, wherein the charge release sub-circuit is respectively connected with the controller, the first conductor and a second conductor in an active area of an array substrate, and the charge release sub-circuit is configured to conduct the first conductor and the second conductor under a control of the controller, so as to allow charges on the second conductor to move to the first conductor.

According to the charge release circuit provided by an example of the present disclosure, the second conductor comprises at least one gate line, the controller comprises a first control line, and the charge release sub-circuit comprises a first charge release unit, and wherein the first charge release unit is respectively connected with the at least one gate line, the first control line and the first conductor, and the first charge release unit is configured to conduct the first conductor and the at least one gate line according to a control signal on the first control line.

According to the charge release circuit provided by an example of the present disclosure, the second conductor comprises a plurality of gate lines, the first charge release unit comprises a plurality of first transistors, the first control line is perpendicular to the gate line, and the plurality of first transistors are in a one-to-one correspondence with the plurality of gate lines; a gate electrode of each of the plurality of first transistors is connected with the first control line, a first electrode of each of the plurality of first transistors is connected with one gate line in the plurality of gate lines, and a second electrode of each of the plurality of first transistors is connected with the first conductor.

According to the charge release circuit provided by an example of the present disclosure, the second conductor comprises at least one data line, the controller comprises a second control line, and the charge release sub-circuit comprises a second charge release unit; and the second charge release unit is respectively connected with the at least one data line, the second control line and the first conductor, and the second charge release unit is configured to conduct the first conductor and the at least one data line according to a control signal on the second control line.

According to the charge release circuit provided by an example of the present disclosure, the second conductor comprises a plurality of data lines, the second charge release unit comprises a plurality of second transistors, the second control line is perpendicular to the data line, and the plurality of second transistors are in a one-to-one correspondence with the plurality of data lines; and a gate electrode of each of the plurality of second transistors is connected with the second control line, a first electrode of each of the plurality of second transistors is connected with one data line in the plurality of data lines, and a second electrode of each of the plurality of second transistors is connected with the first conductor.

According to the charge release circuit provided by an example of the present disclosure, the second conductor further comprises at least one pixel electrode, the controller further comprises a third control line, and the charge release sub-circuit further comprises a third charge release unit, and the third charge release unit is respectively connected with the gate line and the third control line in the array substrate, and the third charge release unit is configured to write a control signal on the third control line into the gate line so as to conduct each pixel electrode and the data line connected with the pixel electrode.

According to the charge release circuit provided by an example of the present disclosure, the third charge release unit comprises a plurality of third transistors, the plurality of third transistors are in a one-to-one correspondence with the plurality of gate lines in the array substrate, and the second conductor comprises a plurality of pixel electrodes connected with each gate line, and the third control line is perpendicular to the gate line, and both a gate electrode and a first electrode of each of the plurality of third transistors are connected with the third control line, and a second electrode of each of the plurality of third transistors is connected with one gate line in the plurality of gate lines.

According to the charge release circuit provided by an example of the present disclosure, a volume of the first conductor is greater than that of the second conductor.

According to the charge release circuit provided by an example of the present disclosure, the first conductor is a common electrode line or a storage electrode line.

At least one example of the present disclosure provides a display substrate, comprising any of the charge release circuits described above.

At least one example of the present disclosure provides a display device, comprising a display panel, wherein the display panel comprises any of the display substrates described above.

At least one example of the present disclosure provides a charge release method of the display device according to claim 11, comprising: applying a control signal to the controller when the display panel is in a black-screen state, conducting the first conductor and the second conductor under the control of the controller, and allowing charges on the second conductor to move to the first conductor.

According to the method provided by an example of the present disclosure, the first conductor is a common electrode line or a storage electrode line, and the second conductor is at least one of a gate line, a data line or a pixel electrode.

According to the charge release circuit provided by an example of the present disclosure, a volume of the first conductor is greater than that of the second conductor.

BRIEF DESCRIPTION OF THE DRAWINGS

In order to clearly illustrate the technical solution of the examples of the disclosure, the drawings of the examples will be briefly described in the following; it is obvious that the described drawings are only related to some examples of the disclosure. Those skilled in the art can also obtain other drawings based on these drawings without any creative work.

DETAILED DESCRIPTION

Figure 1:
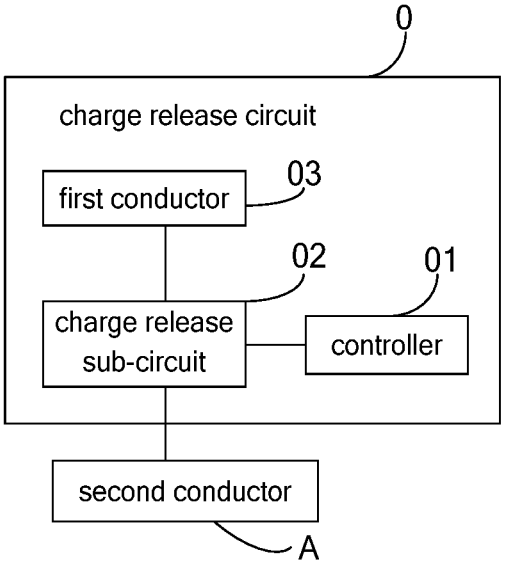
FIG. 1 is a schematic diagram of a structure illustrating a charge release circuit provided by an example of the present disclosure.

In order to make objects, technical details and advantages of the examples of the disclosure apparent, the technical solutions of the examples will be described in a clearly and fully understandable way in connection with the drawings related to the examples of the disclosure. Apparently, the described examples are just a part but not all of the examples of the disclosure. Based on the described examples herein, those skilled in the art can obtain other example(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

When a display panel is not required to be controlled to display an image, as some charges will be left on partial conductors (e.g., gate lines and data lines) in an active area of an array substrate when voltage is applied at the previous moment, partial liquid crystals will still be rotated, so the display panel in a black-screen state will display bright spots.

Transistors adopted in all the examples of the present disclosure can be all TFTs, field effect transistors (FETs) or other elements with same characteristics. In view of the function in a circuit, the transistors adopted in the examples of the present disclosure are mainly switching transistors. As a source electrode and a drain electrode of the switching transistor adopted herein are symmetrical, the source electrode and the drain electrode can be exchanged. In the examples of the present disclosure, in order to distinguish two electrodes of the transistor except a gate electrode, the source electrode is referred to as first electrode and the drain electrode is referred to as second electrode. According to the form in the figure, the gate electrode is disposed in the middle of the transistor, the source electrode is disposed at a signal input end, and the drain electrode is disposed at a signal output end. In addition, the switching transistor adopted in the examples of the present disclosure includes at least one of a P-type switching transistor or an N-type switching transistor. The P-type switching transistor is switched on when the gate electrode is in a low level and switched off when the gate electrode is in a high level. The N-type switching transistor is switched on when the gate electrode is in a high level and switched off when the gate electrode is in a low level.

FIG. 1 is a schematic view illustrating a structure of a charge release circuit 0 provided by an example of the present disclosure. As illustrated in FIG. 1, the charge release circuit 0 can include: a controller 01, a charge release sub-circuit 02 and a first conductor 03. The charge release sub-circuit 02 is respectively connected with the controller 01, the first conductor 03 and a second conductor A in an active area of an array substrate. The controller 01 can be a control module. The charge release sub-circuit 02 can be a charge release module.

The charge release sub-circuit 02 is configured to conduct the first conductor 03 and the second conductor A under a control of the controller 01 to allow charges on the second conductor A to move to the first conductor 03. For instance, the first conductor 03 can be grounded.

For instance, in the charge release circuit provided by the example of the present disclosure, the charge release sub-circuit 02 is respectively connected with the controller 01 and the first conductor 03, and the charge release sub-circuit 02 is configured to conduct the first conductor 03 and the second conductor A in an active area of the array substrate under the function of the controller 01, so that the charge on the second conductor A can be moved to the first conductor 03, thereby reducing the quantity of the charges on the second conductor A in the active area of the array substrate, so as to reduce the rotation probability of liquid crystals when the display panel is in a black-screen state, and reduce the number of bright spots on the display panel in the black-screen state.

Figure 2A:
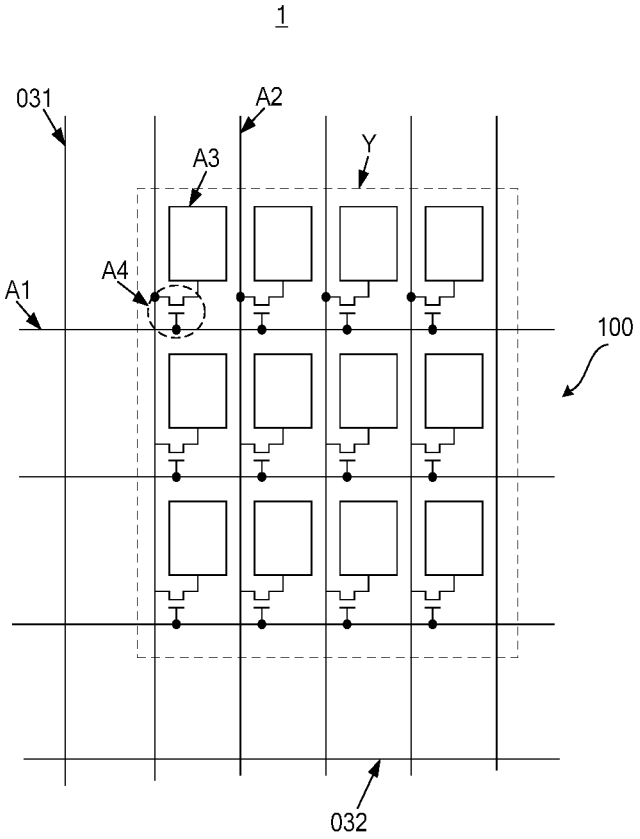
FIG. 2A is a schematic view illustrating a structure of an array substrate.

FIG. 2A is a schematic view illustrating a structure of an array substrate 1. As illustrated in FIG. 2A, the array substrate 1 can include a base substrate 100, a plurality of gate lines A1 and a plurality of data lines A2 are formed in an active area Y of the base substrate 100 and are insulated from each other and intersected with each other to form a plurality of pixel regions. A transistor A4 and a pixel electrode A3 are formed in each of the plurality of pixel regions, a gate electrode of the transistor A4 is connected with the gate line A1 through which the pixel region is formed, a source electrode of the transistor A4 is connected with the data line A2 through which the pixel region is formed, and a drain electrode of the transistor A4 is connected with a pixel electrode A3 in the pixel region. For instance, a first common electrode line 031 and a second common electrode line 032 are formed in a non-active area (namely an edge area) of the base substrate 100. For instance, the first common electrode line 031 is perpendicular to the gate line A1, and the second common electrode line 032 is perpendicular to the data line A2. For instance, the first common electrode line 031 is insulated from the gate line A1, and the second common electrode line 032 is insulated from the data line A2. For instance, the data line is configured to input a data signal into a pixel, and the data signal, for instance, includes a grayscale voltage. For instance, the gate line is configured to input a gate signal into the transistor, and the gate signal, for instance, includes a gate voltage.

Figure 2B:
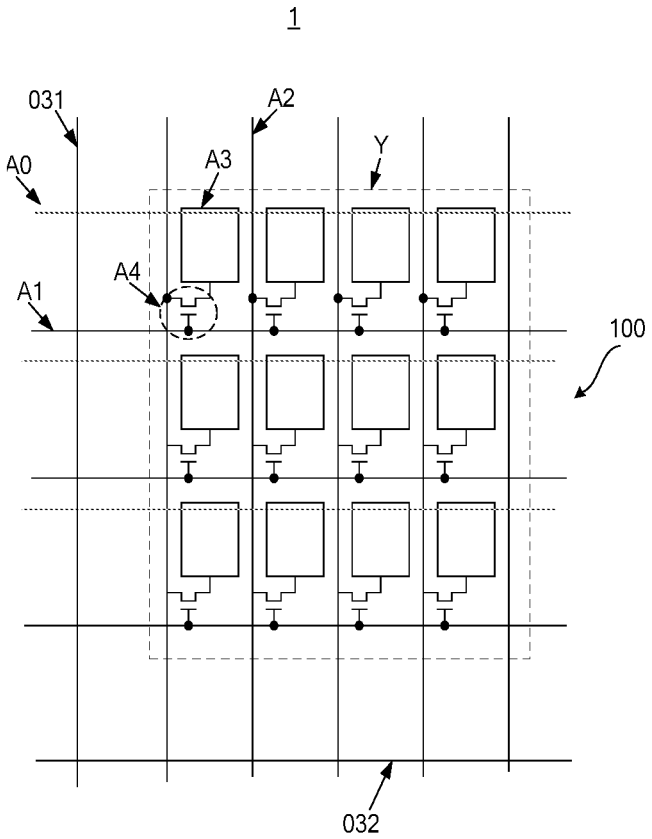
FIG. 2B is a schematic view illustrating a structure of another array substrate.

As illustrated in FIG. 2B, a plurality of storage electrode lines A0 can further be formed in the active area Y of the base substrate 100, and each of the plurality of storage electrode lines A0 can run through a row of pixel regions and is parallel with the gate line A1.

For instance, as illustrated in FIGS. 2A and 2B, the transistors A4 are arranged in an array, each of the plurality of gate lines is connected with a row of transistors A4, each of the plurality of the data line is connected with a column of transistors A4, and each pixel electrode is connected with a transistor A4. The pixel electrode corresponding to each gate line is: a pixel electrode connected with the gate line through the transistor A4. The data line corresponding to each pixel electrode is: a data line connected with the pixel electrode through the transistor A4.

For instance, a volume of the first conductor 03 can be greater than that of the second conductor A. At this point, as the volume of the first conductor 03 is large, the quantity of charges that can be carried by the first conductor 03 is also large, so the first conductor 03 can carry more charges for the second conductor A. For instance, a line width of the first conductor 03 can be greater than that of the second conductor A, so the quantity of charges that can be carried by the first conductor 03 is large. Illustratively, the array substrate can include a base substrate, and multiple wires can be formed on the base substrate, a common electrode line and a storage electrode line are wide and other wires (e.g., gate line and data line) are narrow, the first conductor 03 can be the common electrode line or the storage electrode line on the array substrate, and the second conductor A can be any conductor in the active area of the array substrate, for instance, the second conductor A can be a gate line, a data line or a pixel electrode.

Description will be given below to the charge release circuit provided by the examples of the present disclosure by taking the case that the first conductor is the common electrode line on the array substrate and the second conductor is respectively the gate line, the data line or the pixel electrode on the array substrate as an example.

In the first aspect, the second conductor can include at least one gate line, the controller can include a first control line, the charge release sub-circuit can include a first charge release unit, and the first charge release unit is respectively connected with the at least one gate line, the first control line and the first conductor, and the first charge release unit is configured to conduct the first conductor and the at least one gate line according to a control signal on the first control line.

Figure 3:
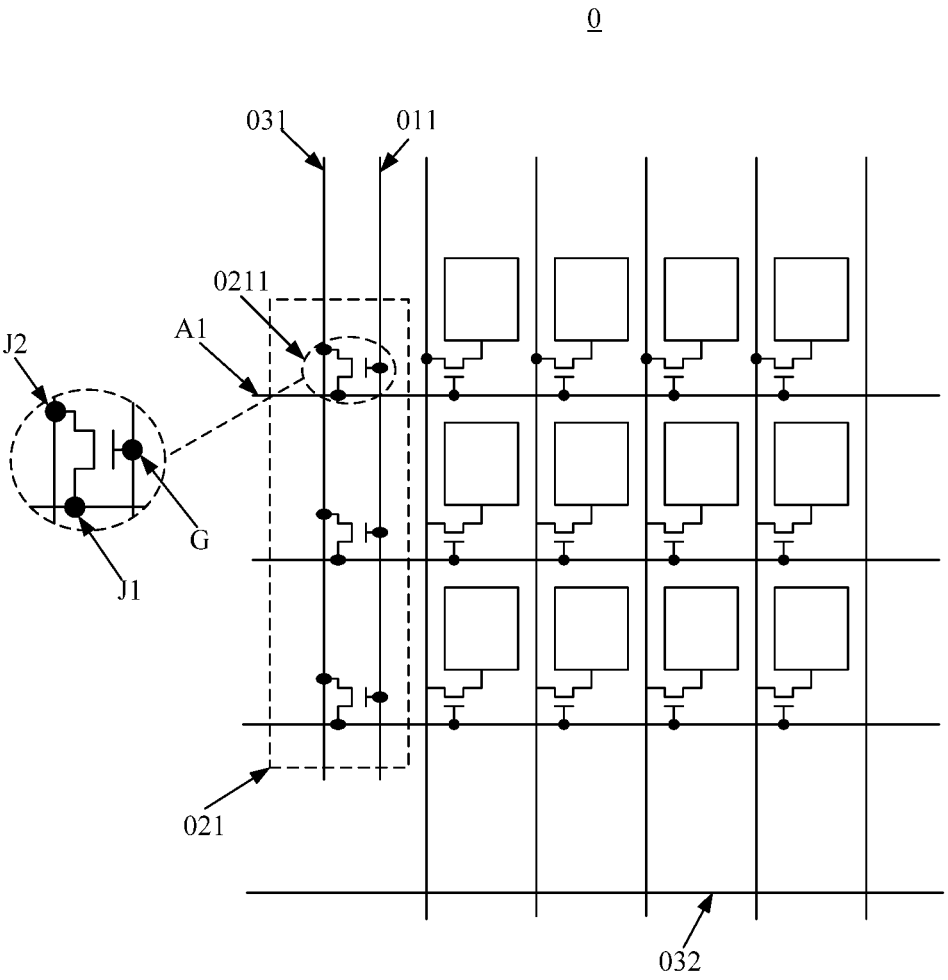
FIG. 3 is a schematic view illustrating a structure of another charge release circuit provided by an example of the present disclosure.

FIG. 3 is a schematic view illustrating a structure of a charge release circuit 0 provided by an example of the present disclosure. As illustrated in FIG. 3, the second conductor can include a plurality of gate lines A1, a first charge release unit 021 can include a plurality of first transistors 0211, and the plurality of first transistors 0211 are in a one-to-one correspondence with the plurality of gate lines A1. A gate electrode G of each of the plurality of first transistors 0211 is connected with a first control line 011, a first electrode J1 of each of the plurality of first transistors 0211 is connected with the gate line A1 corresponding to the first transistor, a second electrode J2 of each of the plurality of first transistors 0211 is connected with a first common electrode line 031 perpendicular to the gate line A1, and the first control line 011 is perpendicular to the gate line A1. For instance, the first control line 011 is insulated from the gate line A1.

When a display panel is required to be controlled to be in a black-screen state, a control signal can be inputted into the first control line 011, so that each of the plurality of first transistors 0211 in the plurality of first transistors 0211 can be in an on state (namely the first electrode J1 and the second electrode J2 of each of the plurality of first transistors 0211 are in the on state), and then each of the plurality of first transistors 0211 conducts the gate line A1 and the first common electrode line 031 which are connected by the first transistor. At this point, if there are residual charges on the gate line A1, the residual charges can flow towards the first common electrode line 031, so the quantity of charges on the gate line A1 can be reduced. At this point, the first conductor for carrying the charges on the second conductor is the first common electrode line 031. After the display panel is in the black-screen state, the quantity of charges on the gate line is small, thereby preventing liquid crystals from being rotated under an action of voltage, so as to avoid bright spots to be displayed on the display panel, and solve the problem of bright spots being displayed by the display panel in the black-screen state.

In the second aspect, the second conductor can include at least one data line, the controller can include a second control line, the charge release sub-circuit can include a second charge release unit, and the second charge release unit can be respectively connected with the at least one data line, the second control line and the first conductor, and the second charge release unit is configured to conduct the first conductor and the at least one data line according to a control signal on the second control line.

Figure 4:
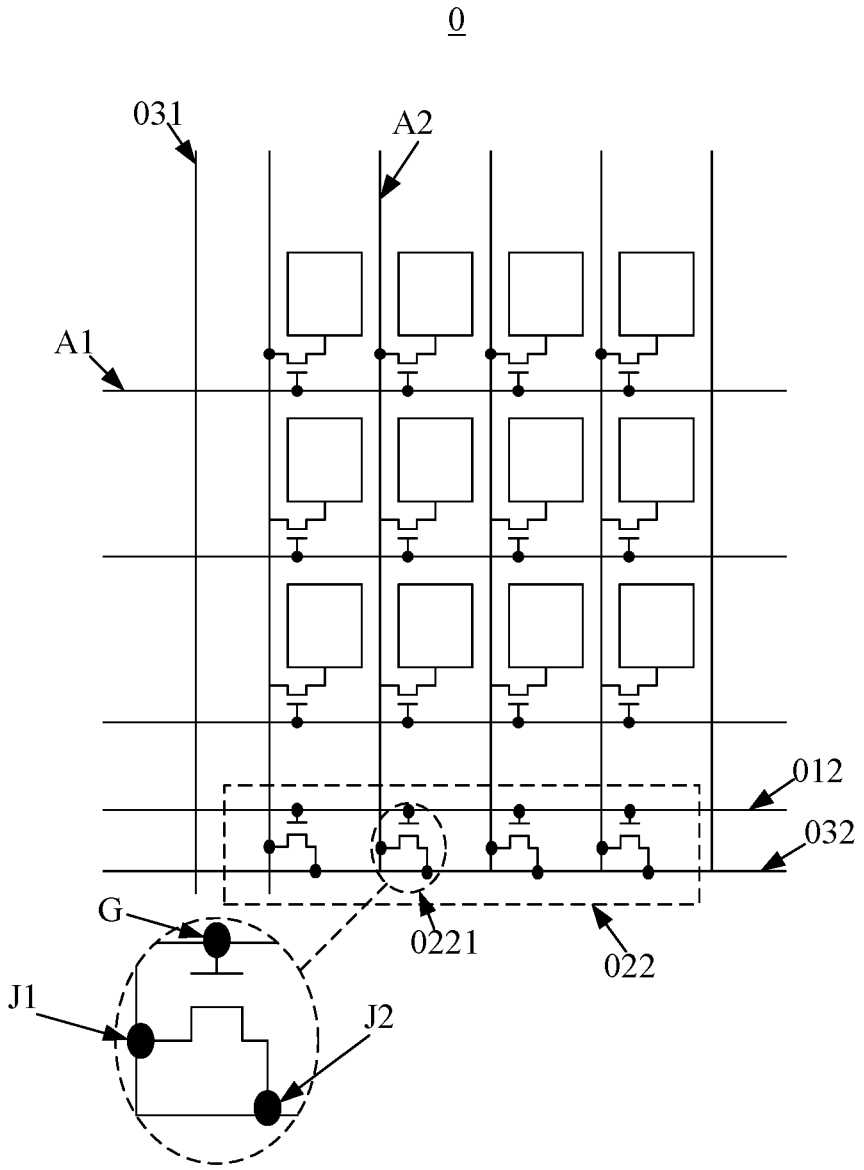
FIG. 4 is a schematic view illustrating a structure of still another charge release circuit provided by an example of the present disclosure.

FIG. 4 is a schematic view illustrating a structure of still another charge release circuit 0 provided by an example of the present disclosure. As illustrated in FIG. 4, the at least one data line in a second conductor can include a plurality of data lines A2, a second charge release unit 022 can include a plurality of second transistors 0221, and the plurality of second transistors 0221 can be in a one-to-one correspondence with the plurality of data lines A2. A gate electrode G of each of the plurality of second transistors 0221 is connected with the second control line 012, a first electrode J1 of each of the plurality of second transistors 0221 is connected with the data line A2 corresponding to the second transistor, and a second electrode J2 of each of the plurality of second transistors 0221 is connected with a second common electrode line 032 perpendicular to the data line A2. For instance, the second control line 012 can be perpendicular to the data line A2.

When the display panel is required to be controlled to be in a black-screen state, a control signal can be inputted into the second control line 012, so that each of the plurality of second transistors 0221 can be in an on state so as to conduct the data line A2 and the second common electrode line 032 which are connected by the second transistor. At this point, if there are residual charges on the data line A2, the residual charges can flow towards the second common electrode line 032, so the quantity of charges on the data line A2 can be reduced. At this point, the first conductor for carrying the charges on the second conductor is the second common electrode line 032. After the display panel is in a black-screen state, the quantity of charges on the data line is small, thereby preventing liquid crystals from being rotated under an action of voltage so as to avoid bright spots to be displayed on the display panel.

In the third aspect, on the basis of the second aspect, the second conductor can further include at least one pixel electrode, the controller can further include a third control line, the charge release sub-circuit can further include a third charge release unit, and the third charge release unit can be respectively connected with the gate line and the third control line in the array substrate, and the third charge release unit is configured to write a control signal on the third control line into the gate line so as to conduct the pixel electrode and the data line corresponding to the pixel electrode.

Figure 5:
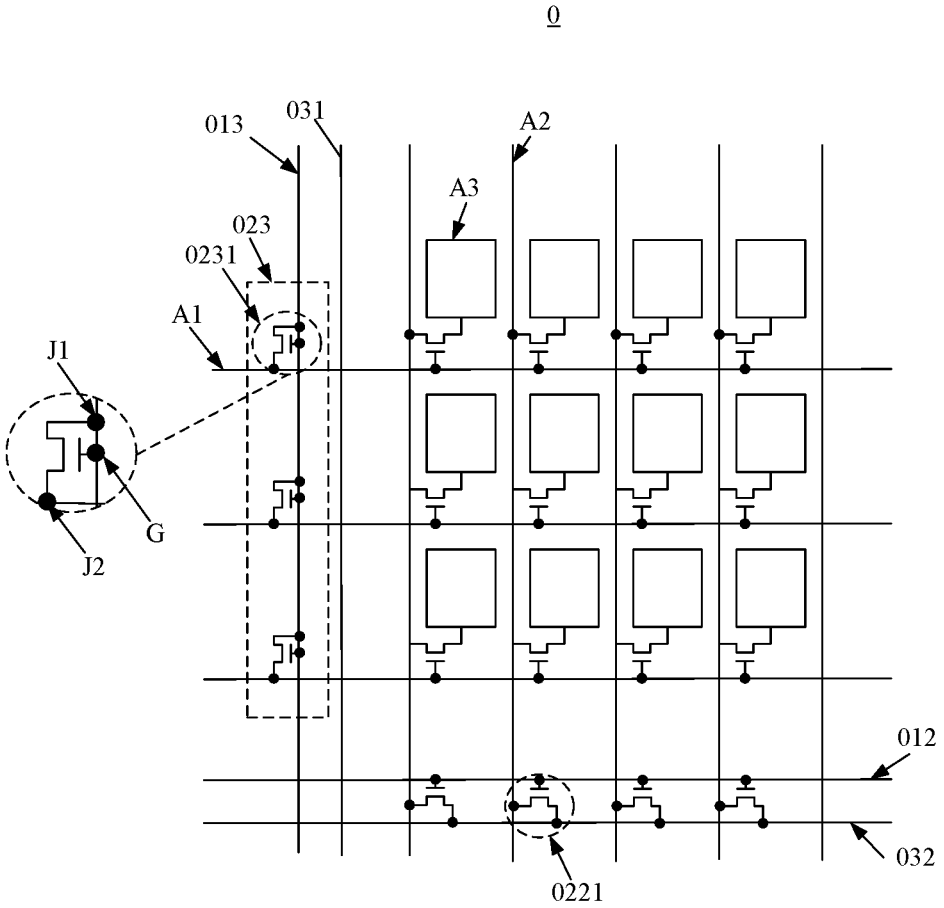
FIG. 5 is a schematic view illustrating a structure of still another charge release circuit provided by an example of the present disclosure.

FIG. 5 is a schematic view illustrating a structure of still another charge release circuit 0 provided by an example of the present disclosure. As illustrated in FIG. 5, on the basis of FIG. 4, the charge release sub-circuit can further include a third charge release unit 023, the third charge release unit 023 can include a plurality of third transistors 0231 which are in a one-to-one correspondence with the plurality of gate lines A1 in the array substrate, at least one pixel electrode in a second conductor can include a plurality of pixel electrodes A3 corresponding to each gate line A1, both a gate electrode G and a first electrode J1 of each of the plurality of third transistors 0231 are connected with a third control line 013, a second electrode J2 of each of the plurality of third transistors 0231 is connected with the gate line A1 corresponding to the third transistor 0231, and the third control line 013 can be perpendicular to the gate line A1.

When the display panel is required to be controlled to be in a black-screen state, a control signal can also be inputted into the third control line 013, so that each of the plurality of third transistors 0231 can be in an on state. Thus, the control signal on the third control line 013 can be inputted into the gate line A1 corresponding to the third transistor 0231 along the first electrode and the second electrode of the third transistor 0231, and the transistors in the pixel regions connected with the gate line A1 are switched on, and hence the pixel electrode A3 corresponding to the gate line A1 and the data line A2 corresponding to the pixel electrode A3 can be conducted with each other. For instance, a control signal can also be inputted into the second control line 012, so that each of the plurality of second transistors 0221 can be in an on state so as to conduct the data line A2 and the second common electrode line 032 which are connected by the second transistor. At this point, if there are residual charges on the pixel electrode A3, the residual charges can flow towards the data line A2 and then flow towards the second common electrode line 032, so the quantity of charges on the data line A2 and the pixel electrode A3 can be reduced. At this point, the first conductor for carrying the charges on the second conductor is the second common electrode line 032. After the display panel is in a black-screen state, the quantity of charges on the data line and the pixel electrode is small, thereby preventing liquid crystals from being rotated under an action of voltage so as to avoid bright spots to be displayed on the display panel.

Figure 6:
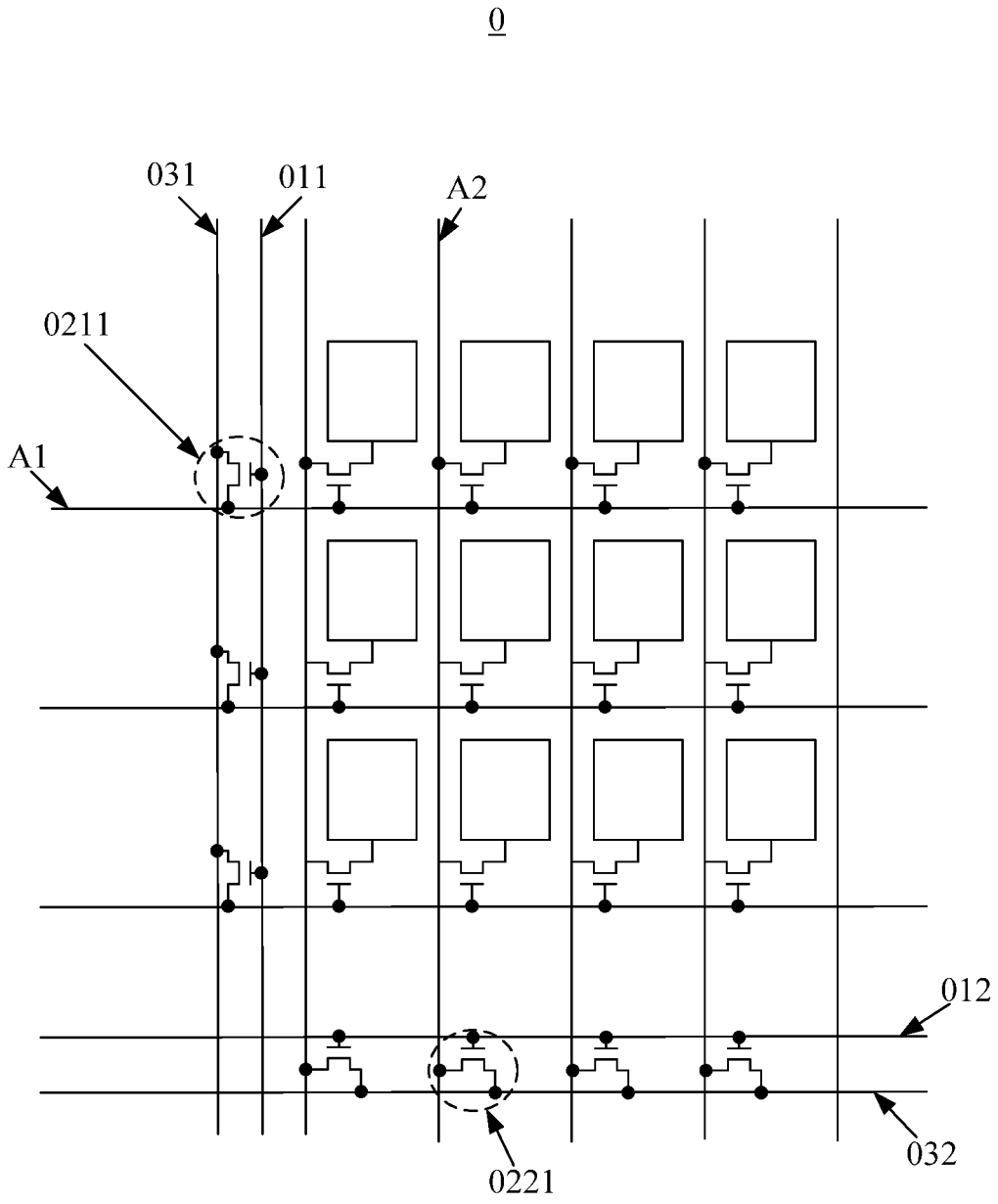
FIG. 6 is a schematic view illustrating a structure of a charge release circuit provided by another example of the present disclosure.

In the fourth aspect, FIG. 6 is a schematic view illustrating a structure of a charge release circuit 0 provided by another example of the present disclosure. As illustrated in FIG. 6, a second conductor includes a plurality of gate lines A1 and a plurality of data lines A2 on an array substrate, and the charge release circuit 0 can include a plurality of first transistors 0211, a plurality of second transistors 0221, a first control line 011, a second control line 012, a first common electrode line 031 and a second common electrode line 032.

For instance, the first common electrode line 031 is perpendicular to the gate line A1 and parallel with the data line A2, the first control line 011 is parallel with the first common electrode line 031, the second common electrode line 032 is perpendicular to the data line A2 and parallel with the gate line A1, the second control line 012 is parallel with the second common electrode line 032, the plurality of first transistors 0211 are in a one-to-one correspondence with the plurality of gate lines A1, and the plurality of second transistors 0221 are in a one-to-one correspondence with the plurality of data lines A2. A gate electrode of each of the plurality of first transistors 0211 is connected with the first control line 011, a first electrode of each of the plurality of first transistors 0211 is connected with the gate line A1 corresponding to the first transistor, and a second electrode of each of the plurality of first transistors 0211 is connected with the first common electrode line 031. A gate electrode of each of the plurality of second transistors 0221 is connected with the second control line 012, a first electrode of each of the plurality of second transistors 0221 is connected with the data line A2 corresponding to the second transistor, and a second electrode of each of the plurality of second transistors 0221 is connected with the second common electrode line 032.

When the display panel is required to be controlled to be in a black-screen state, a control signal can be inputted into the first control line 011, so that each of the plurality of first transistors 0211 can be in an on state so as to conduct the gate line A1 and the first common electrode line 031 which are connected by the first transistor. At this point, if there are residual charges on the gate line A1, the residual charges can flow towards the first common electrode line 031, so the quantity of charges on the gate line A1 can be reduced. A control signal can also be inputted into the second control line 012, so that each of the plurality of second transistors 0221 can be in an on state so as to conduct the data line A2 and the second common electrode line 032 which are connected by the second transistor. At this point, if there are residual charges on the data line A2, the residual charges can flow towards the second common electrode line 032, so the quantity of charges on the data line A2 can be reduced. At this point, the first conductor for carrying the charges on the second conductor is the first common electrode line 031 and the second common electrode line 032. After the display panel is in a black-screen state, the quantity of charges on the data line is small.

Figure 7:
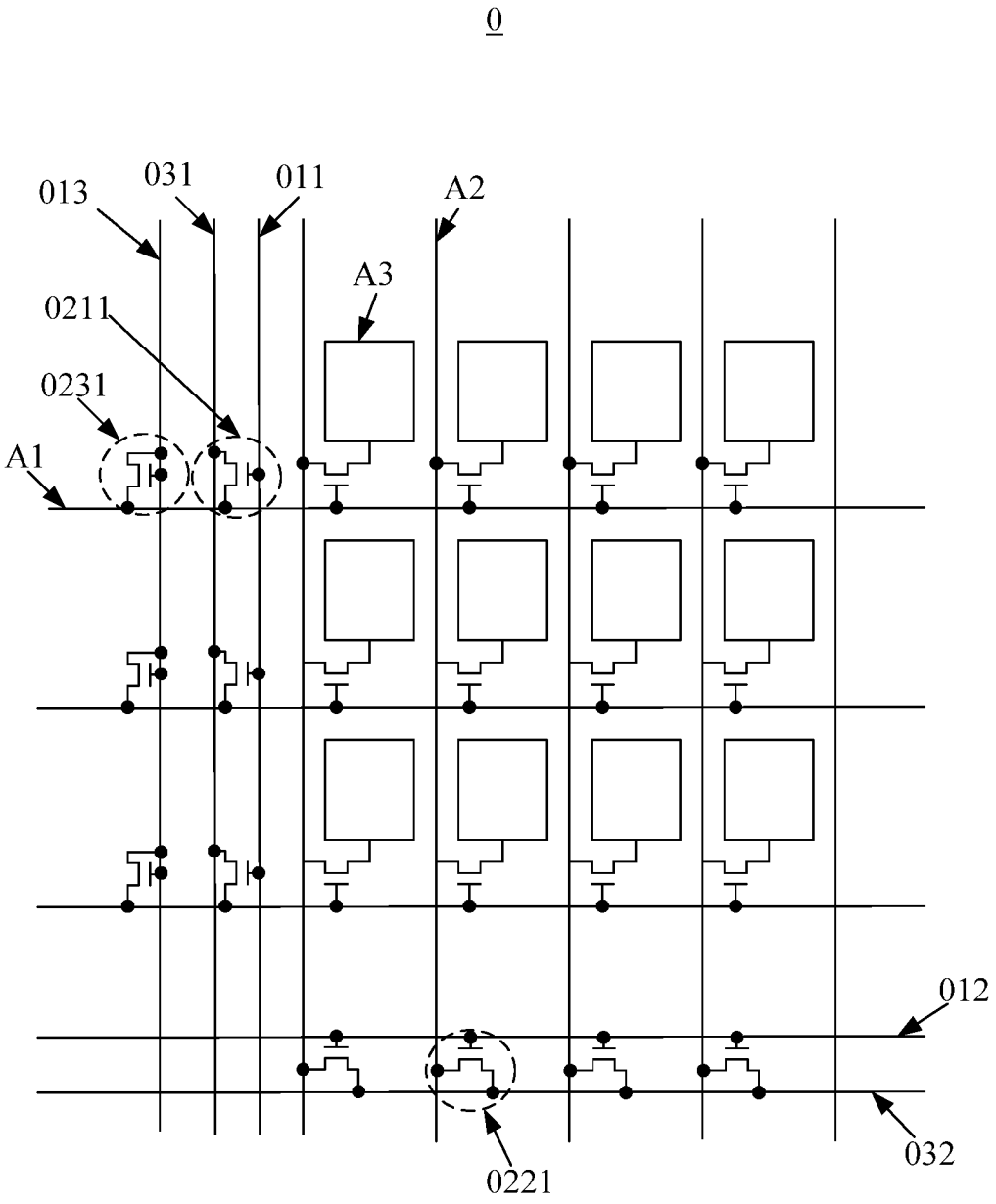
FIG. 7 is a schematic view illustrating a structure of another charge release circuit provided by another example of the present disclosure.

In the fifth aspect, FIG. 7 is a schematic view illustrating a structure of another charge release circuit 0 provided by another example of the present disclosure. As illustrated in FIG. 7, the second conductor includes a plurality of gate lines A1, a plurality of data lines A2 and a plurality of pixel electrodes A3 on the array substrate, and the charge release circuit 0 can include a plurality of first transistors 0211, a plurality of second transistors 0221, a plurality of third transistors 0231, a first control line 011, a second control line 012, a third control line 013, a first common electrode line 031 and a second common electrode line 032.

For instance, the first common electrode line 031 is perpendicular to the gate line A1 and parallel with the data line A2, both the first control line 011 and the third control line 013 are parallel with the first common electrode line 031 and disposed near the first common electrode line 031. For instance, the first control line 011 is disposed on a side of the first common electrode line 031 close to the active area, and the third control line 013 is disposed on a side of the first common electrode line 031 far away from the active area. The second common electrode line 032 is perpendicular to the data line A2 and parallel with the gate line A1. The second control line 012 is parallel with the second common electrode line 032 and disposed near the second common electrode line 032, for instance, disposed on a side of the second common electrode line 032 close to the active area.

The plurality of first transistors 0211 are in a one-to-one correspondence with the plurality of gate lines A1, the plurality of second transistors 0221 are in a one-to-one correspondence with the plurality of data lines A2, and the plurality of third transistors 0231 are in a one-to-one correspondence with the plurality of gate lines A1. A gate electrode of each of the plurality of first transistors 0211 is connected with the first control line 011, a first electrode of each of the plurality of first transistors 0211 is connected with the gate line A1 corresponding to the first transistor, and a second electrode of each of the plurality of first transistors 0211 is connected with the first common electrode line 031. A gate electrode of each of the plurality of second transistors 0221 is connected with the second control line 012, a first electrode of each of the plurality of second transistors 0221 is connected with the data line A2 corresponding to the second transistor, and a second electrode of each of the plurality of second transistors 0221 is connected with the second common electrode line 032. Both a gate electrode and a first electrode of each of the plurality of third transistors 0231 is connected with the third control line 013, and a second electrode of each of the plurality of third transistors 0231 is connected with the gate line A1 corresponding to the third transistor.

When the display panel is required to be controlled to be in a black-screen state, a control signal can be inputted into the first control line 011, so that each of the plurality of first transistors 0211 can be in an on state so as to conduct the gate line A1 and the first common electrode line 031 which are connected by the first transistor. At this point, if there are residual charges on the gate line A1, the residual charges can flow towards the first common electrode line 031, so the quantity of charges on the gate line A1 can be reduced.

For instance, a control signal can also be inputted into the second control line 012, so that each of the plurality of second transistors 0221 can be in an on state so as to conduct the data line A2 and the second common electrode line 032 which are connected by the second transistor. At this point, if there are residual charges on the data line A2, the residual charges can flow towards the second common electrode line 032, so the quantity of charges on the data line A2 can be reduced. After the display panel is in a black-screen state, the quantity of charges on the data line is small.

Moreover, a control signal can also be inputted into the third control line 013, so that each of the plurality of third transistors 0231 can be in an on state. Thus, the control signal on the third control line 013 can be inputted into the gate line A1 corresponding to the third transistor 0231 along the first electrode and the second electrode of the third transistor 0231, and the pixel electrode A3 corresponding to the gate line A1 and the data line A2 corresponding to the pixel electrode A3 can be conducted with each other. At this point, if there are residual charges on the pixel electrode A3, the residual charges can flow towards the data line A2 and then flow towards the second common electrode line 032, so the quantity of charges on the data line A2 and the pixel electrode A3 can be reduced.

At this point, the first conductor for carrying the charges on the second conductor is the first common electrode line 031 and the second common electrode line 032. After the display panel is in a black-screen state, the quantity of charges on the conductor (e.g., the gate line, the data line and the pixel electrode) in the active area of the array substrate is small, thereby preventing liquid crystals from being rotated under an action of voltage so as to avoid bright spots to be displayed on the display panel.

For instance, in the example of the present disclosure, components with same extension direction can be formed in the same layer. For instance, at least two of the data line A2, the first common electrode line 031, the first control line 011 and the third control line 013 can be formed in the same layer, for instance, located in a first layer. At least two of the gate line A1, the second control line 012 and the second common electrode line 032 can be formed in the same layer, for instance, located in a second layer. For instance, an insulating layer can be disposed between the first layer and the second layer, so that two lines are not electrically connected at an intersection.

For instance, in the examples of the present disclosure, two components can be connected with each other through a transistor. For instance, black dots in the figures can refer to electrical connection. For instance, in the accompanying drawings, two intersected lines are insulated from each other at the intersection.

In summary, in the charge release circuit provided by an example of the present disclosure, the charge release sub-circuit is respectively connected with the controller and the first conductor, and the charge release sub-circuit is configured to conduct the first conductor and the second conductor in an active area of the array substrate under an action of the controller, so that the charges on the second conductor can be moved to the first conductor, thereby reducing the quantity of charges on the second conductor in the active area of the array substrate, so as to reduce the rotation probability of liquid crystals when the display panel is in the black-screen state, and reduce the number of bright spots on the display panel in the black-screen state.

The example of the present disclosure further provides a display substrate, which can include any charge release circuit as illustrated in FIG. 1, FIG. 3, FIG. 4, FIG. 5, FIG. 6 or FIG. 7.

Moreover, an example of the present disclosure further provides a display panel, which can include a display substrate provided with any charge release circuit as illustrated in FIG. 1, FIG. 3, FIG. 4, FIG. 5, FIG. 6 or FIG. 7. For instance, the display substrate can be an array substrate. For instance, the display panel can further include an opposing substrate arranged opposite to the array substrate. For instance, the opposing substrate can be a CF substrate, but not limited thereto. In actual application, the display substrate can also be an opposing substrate. No limitation will be given herein in the examples of the present disclosure.

Moreover, an example of the present disclosure further provides a display device, which includes a display panel. A display substrate in the display panel can include any charge release circuit as illustrated in FIG. 1, FIG. 3, FIG. 4, FIG. 5, FIG. 6 or FIG. 7. The display device can be any product or component with display function such as an LCD panel, e-paper, an organic light-emitting diode (OLED) panel, an active-matrix organic light-emitting diode (AMOLED) panel, a mobile phone, a tablet PC, a TV, a display, a notebook computer, a digital picture frame or a navigator.

At least an example of the present disclosure further provides a charge release method of the display device, which includes releasing charges by utilization of any foregoing charge release circuit. The method includes: applying a control signal to the controller when the display panel is in a black-screen state, conducting the first conductor and the second conductor under a control of the controller, and allowing charges on the second conductor to move to the first conductor.

For instance, when the display panel is in the black-screen state, the display device is in a standby state.

What have been described above are only specific implementations of the present disclosure, the protection scope of the present disclosure is not limited thereto. Any changes or substitutions easily occur to those skilled in the art within the technical scope of the present disclosure should be covered in the protection scope of the present disclosure. Therefore, the protection scope of the present disclosure should be based on the protection scope of the claims.

What is claimed is:

1. A charge release circuit, comprising: a controller, a charge release sub-circuit and a first conductor, wherein the charge release sub-circuit is connected with the controller, the first conductor and a second conductor, respectively, the second conductor is located in an active area of an array substrate, and the charge release sub-circuit is configured to be switched on to electrically connect the first conductor and the second conductor under a control of the controller, so as to allow charges on the second conductor to move to the first conductor, wherein the second conductor comprises at least one data line, the controller comprises a second control line, and the charge release sub-circuit comprises a second charge release unit, wherein the second charge release unit is connected with the at least one data line, the second control line and the first conductor, respectively, and the second charge release unit is configured to electrically connect the first conductor and the at least one data line according to a control signal on the second control line, wherein the second conductor further comprises a gate line and at least one pixel electrode, the controller further comprises a third control line, and the charge release sub-circuit further comprises a third charge release unit, wherein the third charge release unit is connected with the gate line and the third control line in the array substrate, respectively, and the third charge release unit is configured to write a control signal on the third control line into the gate line so as to electrically connect each pixel electrode and the data line connected with the pixel electrode, and wherein the second control line is insulated from the third control line.

2. The charge release circuit according to claim 1, wherein the second conductor comprises at least one gate line, the controller comprises a first control line, and the charge release sub-circuit comprises a first charge release unit, and wherein the first charge release unit is connected with the at least one gate line, the first control line and the first conductor, respectively, and the first charge release unit is configured to be switched on to electrically connect the first conductor and the at least one gate line according to a control signal on the first control line.

3. The charge release circuit according to claim 2, wherein the second conductor comprises a plurality of gate lines, the first charge release unit comprises a plurality of first transistors, the first control line is perpendicular to the gate line, and the plurality of first transistors are in a one-to-one correspondence with the plurality of gate lines;

wherein a gate electrode of each of the plurality of first transistors is connected with the first control line, a first electrode of each of the plurality of first transistors is connected with one gate line in the plurality of gate lines, and a second electrode of each of the plurality of first transistors is connected with the first conductor.

4. The charge release circuit according to claim 1, wherein the second conductor comprises a plurality of data lines, the second charge release unit comprises a plurality of second transistors, the second control line is perpendicular to the data line, and the plurality of second transistors are in a one-to-one correspondence with the plurality of data lines; and wherein a gate electrode of each of the plurality of second transistors is connected with the second control line, a first electrode of each of the plurality of second transistors is connected with one data line in the plurality of data lines, and a second electrode of each of the plurality of second transistors is connected with the first conductor.

5. The charge release circuit according to claim 1, wherein the second conductor comprises a plurality of data lines, the second charge release unit comprises a plurality of second transistors, the second control line is perpendicular to the data line, and the plurality of second transistors are in a one-to-one correspondence with the plurality of data lines; and wherein a gate electrode of each of the plurality of second transistors is connected with the second control line, a first electrode of each of the plurality of second transistors is connected with one data line in the plurality of data lines, and a second electrode of each of the plurality of second transistors is connected with the first conductor.

6. A display device, comprising the charge release circuit according to claim 1.

7. A charge release method of the display device according to claim 6, comprising:

applying a control signal to the controller when the display panel is in a black-screen state, switching on the charge release sub-circuit to electrically connect the first conductor and the second conductor under the control of the controller, and allowing charges on the second conductor to move to the first conductor.

8. A charge release method according to claim 7, wherein switching on the charge release sub-circuit to electrically connect the first conductor and the second conductor under the control of the controller comprises:

inputting a control signal into the second control line, and allowing charges on the data line to move to the first conductor; and inputting a control signal into the third control line, and allowing charges on the pixel electrode to move to the first conductor.

9. A charge release circuit, comprising: a controller, a charge release sub-circuit and a first conductor, wherein the charge release sub-circuit is connected with the controller, the first conductor and a second conductor, respectively, the second conductor is located in an active area of an array substrate, and the charge release sub-circuit is configured to be switched on to electrically connect the first conductor and the second conductor under a control of the controller, so as to allow charges on the second conductor to move to the first conductor, wherein the second conductor comprises at least one gate line, the controller comprises a first control line, and the charge release sub-circuit comprises a first charge release unit, and wherein the first charge release unit is respectively connected with the at least one gate line, the first control line and the first conductor, respectively, and the first charge release unit is configured to conduct be switched on to electrically connect the first conductor and the at least one gate line according to a control signal on the first control line, wherein the second conductor comprises at least one data line, the controller comprises a second control line, and the charge release sub-circuit comprises a second charge release unit; and wherein the second charge release unit is respectively connected with the at least one data line, the second control line and the first conductor, respectively, and the second charge release unit is configured to conduct be switched on to electrically connect the first conductor and the at least one data line according to a control signal on the second control line, wherein the second conductor comprises a plurality of data lines, the second charge release unit comprises a plurality of second transistors, the second control line is perpendicular to the data line, and the plurality of second transistors are in a one-to-one correspondence with the plurality of data lines; and wherein a gate electrode of each of the plurality of second transistors is connected with the second control line, a first electrode of each of the plurality of second transistors is connected with one data line in the plurality of data lines, and a second electrode of each of the plurality of second transistors is connected with the first conductor, wherein the second conductor further comprises at least one pixel electrode, the controller further comprises a third control line, and the charge release sub-circuit further comprises a third charge release unit, and wherein the third charge release unit is connected with the gate line and the third control line in the array substrate, respectively, and the third charge release unit is configured to write a control signal on the third control line into the gate line so as to electrically connect each pixel electrode and the data line connected with the pixel electrode.

10. The charge release circuit according to claim 9, wherein the third charge release unit comprises a plurality of third transistors, the plurality of third transistors are in a one-to-one correspondence with the plurality of gate lines in the array substrate, and the second conductor comprises a plurality of pixel electrodes connected with each gate line, and the third control line is perpendicular to the gate line, and wherein both a gate electrode and a first electrode of each of the plurality of third transistors are connected with the third control line, and a second electrode of each of the plurality of third transistors is connected with one gate line in the plurality of gate lines.

11. The charge release circuit according to claim 9, wherein a volume of the first conductor is greater than that of the second conductor.

12. The charge release circuit according to claim 9, wherein the first conductor is a common electrode line or a storage electrode line.

13. A display substrate, comprising the charge release circuit according to claim 9.

14. A display device, comprising a display panel, wherein the display panel comprises the display substrate according to claim 13.

15. A charge release method of the display device according to claim 14, comprising:

applying a control signal to the controller when the display panel is in a black-screen state, switching on the charge release sub-circuit to electrically connect the first conductor and the second conductor under the control of the controller, and allowing charges on the second conductor to move to the first conductor.

16. The method according to claim 15, wherein the first conductor is a common electrode line or a storage electrode line, and the second conductor is at least one of a gate line, a data line or a pixel electrode.

17. The method according to claim 15, wherein a volume of the first conductor is greater than that of the second conductor.

18. The charge release circuit according to claim 9, wherein a line width of the first conductor is greater than that of the second conductor.

19. A charge release circuit, comprising: a controller, a charge release sub-circuit and a first conductor, wherein the charge release sub-circuit is connected with the controller, the first conductor and a second conductor, respectively, the second conductor is located in an active area of an array substrate, and the charge release sub-circuit is configured to be switched on to electrically connect the first conductor and the second conductor under a control of the controller, so as to allow charges on the second conductor to move to the first conductor, wherein the second conductor comprises at least one gate line, the controller comprises a first control line, and the charge release sub-circuit comprises a first charge release unit, and wherein the first charge release unit is respectively connected with the at least one gate line, the first control line and the first conductor, respectively, and the first charge release unit is configured to be switched on to electrically connect the first conductor and the at least one gate line according to a control signal on the first control line, wherein the second conductor comprises a plurality of gate lines, the first charge release unit comprises a plurality of first transistors, the first control line is perpendicular to the gate line, and the plurality of first transistors are in a one-to-one correspondence with the plurality of gate lines;

wherein a gate electrode of each of the plurality of first transistors is connected with the first control line, a first electrode of each of the plurality of first transistors is connected with one gate line in the plurality of gate lines, and a second electrode of each of the plurality of first transistors is connected with the first conductor, wherein the second conductor comprises at least one data line, the controller comprises a second control line, and the charge release sub-circuit comprises a second charge release unit; and wherein the second charge release unit is respectively connected with the at least one data line, the second control line and the first conductor, respectively, and the second charge release unit is configured to be switched on to electrically connect the first conductor and the at least one data line according to a control signal on the second control line, wherein the second conductor comprises a plurality of data lines, the second charge release unit comprises a plurality of second transistors, the second control line is perpendicular to the data line, and the plurality of second transistors are in a one-to-one correspondence with the plurality of data lines; and wherein a gate electrode of each of the plurality of second transistors is connected with the second control line, a first electrode of each of the plurality of second transistors is connected with one data line in the plurality of data lines, and a second electrode of each of the plurality of second transistors is connected with the first conductor, wherein the second conductor further comprises at least one pixel electrode, the controller further comprises a third control line, and the charge release sub-circuit further comprises a third charge release unit, and wherein the third charge release unit is connected with the gate line and the third control line in the array substrate, and the third charge release unit is configured to write a control signal on the third control line into the gate line so as to electrically connect each pixel electrode and the data line connected with the pixel electrode.

20. The charge release circuit according to claim 19, wherein the third charge release unit comprises a plurality of third transistors, the plurality of third transistors are in a one-to-one correspondence with the plurality of gate lines in the array substrate, and the second conductor comprises a plurality of pixel electrodes connected with each gate line, and the third control line is perpendicular to the gate line, and wherein both a gate electrode and a first electrode of each of the plurality of third transistors are connected with the third control line, and a second electrode of each of the plurality of third transistors is connected with one gate line in the plurality of gate lines.

* * * * *